United States Patent [19]

Her

[11] Patent Number: 4,905,857

[45] Date of Patent: Mar. 6, 1990

[54] PORTABLE DIVING BOX

[76] Inventor: Ming L. Her, No. 24, Alley 3, Lane 42, Shiang Shang Rd., Sec. 2, Nan Twen Chiu, Taichung, Taiwan

[21] Appl. No.: 204,516

[22] Filed: Jun. 9, 1988

[51] Int. Cl.[4] ..... B65D 81/22

[52] U.S. Cl. ..... 220/4 B; 190/28; 206/811; 224/224

[58] Field of Search ..... 190/28; 206/811; 220/4 B, 234, 358; 224/224, 225, 226, 908, 909

[56] References Cited

U.S. PATENT DOCUMENTS

| | | | |
|---|---|---|---|
| Re. 16,479 | 11/1926 | Benjamin et al. | 206/811 |
| 1,573,239 | 2/1926 | Gillilard | 206/811 |
| 1,628,961 | 5/1927 | Eyer et al. | 206/811 |
| 1,809,696 | 6/1931 | Heilweil | 206/811 |
| 1,961,181 | 6/1934 | Von Der Heydt | 206/811 |
| 2,565,939 | 8/1951 | Wriston | 190/28 |
| 2,604,961 | 7/1952 | Koch | 190/28 |
| 2,803,368 | 8/1957 | Koch | 220/4 B |
| 3,966,076 | 6/1976 | Kroger et al. | 220/4 B |
| 4,465,189 | 8/1984 | Molzan | 206/811 |
| 4,546,874 | 10/1985 | Kirchhan | 220/4 B |

FOREIGN PATENT DOCUMENTS

| | | | |
|---|---|---|---|
| 167668 | 2/1934 | Switzerland | 206/811 |

*Primary Examiner*—George L. Walton

*Attorney, Agent, or Firm*—Bacon & Thomas

[57] ABSTRACT

A diving box, comprising a box body, a cover pivotally joined to the box body which can close up the box body, an element which can exert an effective sealing on the box body and the cover and, a buckle which is joined onto the box body to be tied to the waist of the user. By means of the forementioned fittings, a swimmer or diver can safely carry important personal belongings and prevent their loss.

4 Claims, 3 Drawing Sheets

PORTABLE DIVING BOX

BACKGROUND OF THE INVENTION

1. Field of the Invention

This invention relates to a portable diving case, particularly denoting one which can be tied to the waist of a swimmer or diver, in which the important personal belongings can be safely kept, which will serve as a means to solve the problem usually arising in the seaside, where the swimmers or divers can find place to safely keep his/her important personal belongings, as well as serving as a means to prevent such personal belongings from being lost.

2. Description of the Prior Art

Swimming and diving are the favorite sports of many people. Swimmers or divers sometimes cannot avoid bringing along with them some important personal belongings, such as money, watches, necklace, papers or documents, etc. As these belongings can be easily damaged by water, they have to be taken away from the swimmers or divers and be kept elsewhere. In addition, as no means is provided by the swimming-suits or diving-suits presently available by which one's important personal belongings can be safely kept, many swimmers or divers are often found to be disturbed by the problem of how and where they should keep their personal belongings before they enter into the water.

Of course, the above-mentioned disturbance will not exist in such sea beach where a facility is being provided to keep the personal belongings of swimmers in custody. However, such disturbance really exists in any sea-beach where no such management service is available. Under such circumstances the swimmers or divers will usually lock their personal belongings in their car. However, this is still unsafe because such personal belongings can easily be stolen by burglers, and some swimmers or divers do not drive their cars to the beach. Of course, the relatives or friends who accompanied the swimmers or divers to the beach can protect the personal belongings they brought along with them. However, in so doing, they may lose the fun of playing together.

SUMMARY OF THE INVENTION

Development of the present invention resulted in a fitting which comprises a casing body into which the personal belongings of someone can be contained and kept, a cove which can be pivotly joined with the forementioned casing body to compactly seal the opening of the casing body, an element which can exert an effective sealing on the space between the casing body and the cover and a buckle joining to the two lateral sides of the casing body for attachment to the waist of the user. The important personal belongings of a swimmer or diver can be put into the fitting to solve the problem of where and how the important belongings of a swimmer or diver can be safely kept, without worrying about their being lost or stolen.

Therefore, the object of this invention is to provide a simple but effective design which enables the important personal belongings of a swimmer or diver to be safely kept in a diving box which is entirely sealed and tied to the waist of a swimmer or diver, to the effect of not causing any hindrance to the swimming or diving motion to be conducted by the swimmer or diver.

BRIEF DESCRIPTION OF THE DRAWINGS

Other features and objects of the present invention can be readily understood from the following detailed description and disclosure, especially in light of the accompanying drawings, wherein like numerals referred to corresponding parts in the several diagrammaviews, in which.

DETAILED DESCRIPTION OF THE PREFERRED EMBODIMENT

Figure 1:
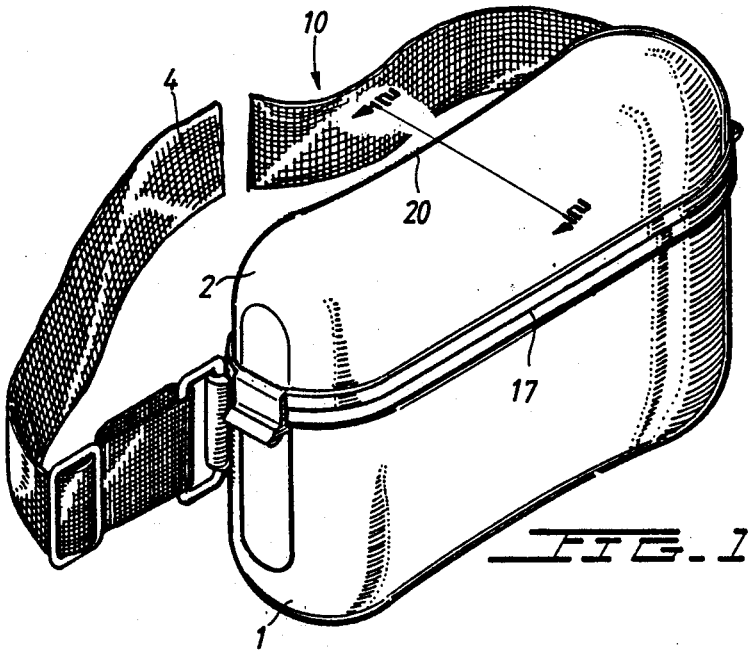
FIG. 1 is a perspective view of a diving box according to the present invention.
Figure 2:
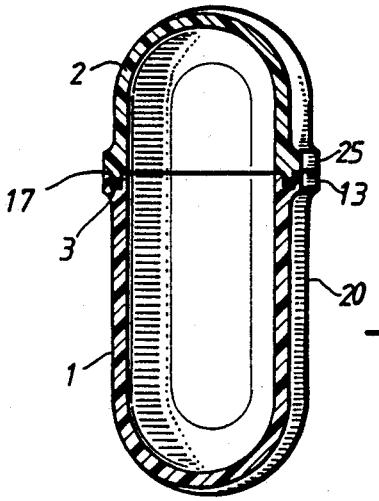
FIG. 2 is the cross-sectional view taken along the 2—2 line of FIG. 1.
Figure 4:
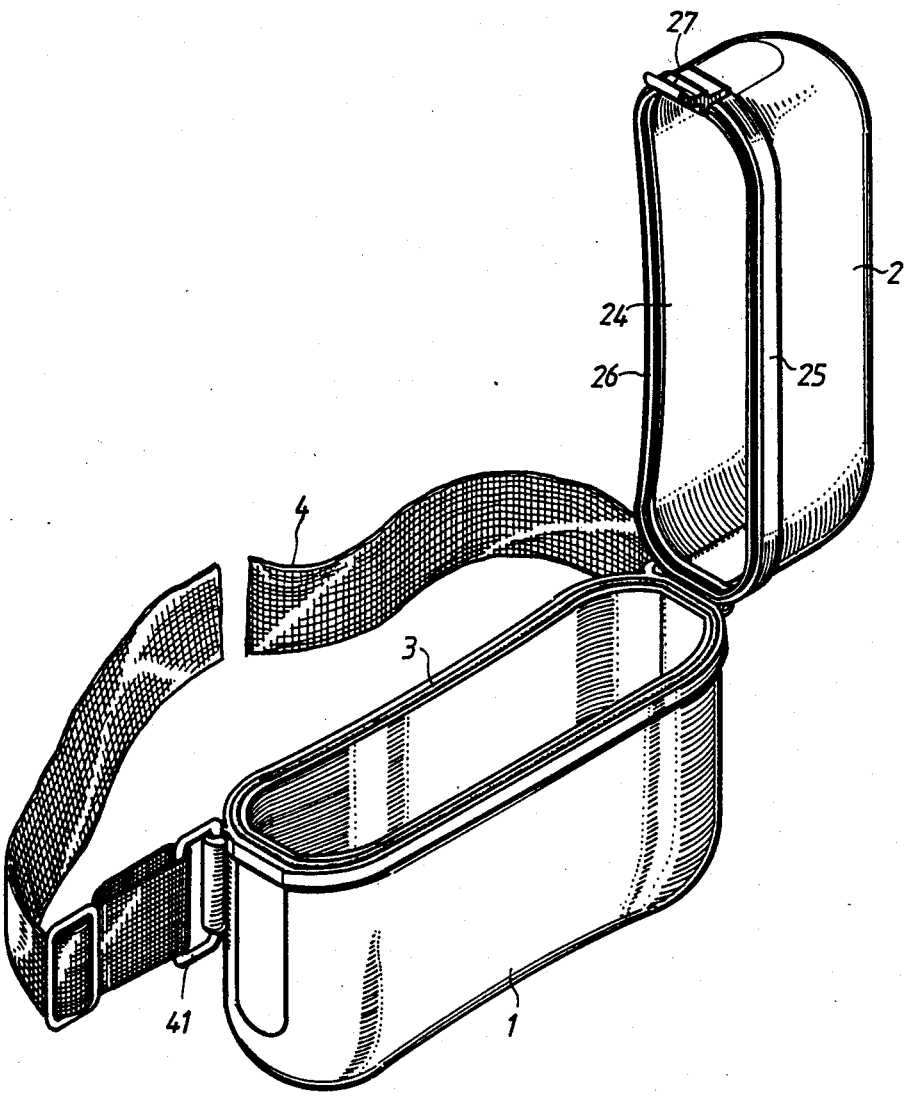
FIG. 4 is a perspective view of the diving box of the present invention after the cover has been opened.

The outer view of the diving box of the present invention is shown in FIG. 1. In the drawing of the preferred embodiment as shown in FIG. 4, it can be seen that the cross-section of the diving box is generally formed in a horizontally oval shape while its longitudinal cross-section is generally formed in a longitudinal oval shape as is shown in FIG. 2. This design not only can diminish the excessive projection of the diving box when it is being tied to the waist of the swimmer, but also allows the diving box to have a larger capacity. On the other hand, the plane of contact 20 concave or made between the diving box and the waist of a user is so designed that it is made of an oval shape which tends to go in an inward direction, so as to match with the oval shape of the waist of a swimmer, so that the diving box can be closely and comfortably engaged with the waist of a user. However, other shapes can also be adopted.

Figure 3:
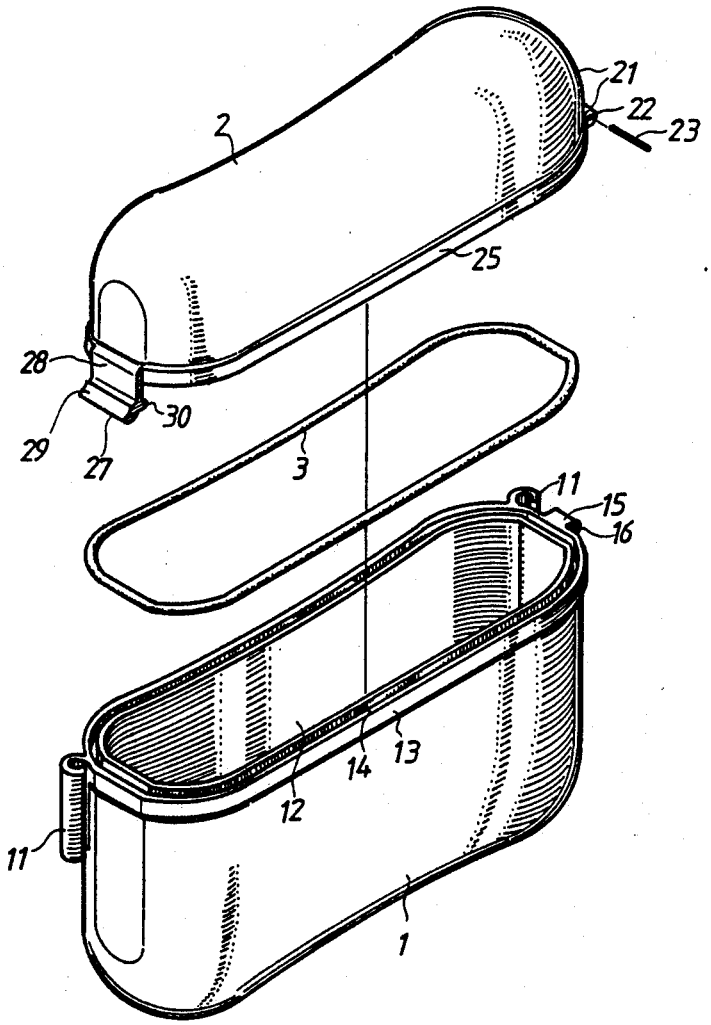
FIG. 3 is an exploded perspective view of the diving box without the waist belt.

As is shown in FIGS. 2 and 3, it can be seen that a diving box 10 can be made of any suitable material. However, the material most preferred would be plastics, such as synthetic resins, which can be easily formed, light but durable and strong in its anti-corrosion properties. The forementioed diving box 10 is an assembly of a box body 1, a cover 2, a sealing member 3 and a waist belt 4, wherein the box body 1 is made of a concave shell where its bottom is tightly sealed, into which money, watches, necklaces, opticals and other personal belongings can be put and kept. A hollow cylindrical-shaped buckling hook 11 is set at each end of the forementioned box body 1. In the example of a preferred embodiment, the buckling hooks 11 and the box body 1 are integrally formed into one body. Each hook 11 is provided with a longitudinal slot aperture in its sidewall for receiving a buckling ring 41 of waist belt 4 as shown in FIG. 1 and 4. As the buckling hook 11 is made of plastic, and has a considerable elasticity to permit the squeezing of buckling ring 41 having an external diameter slightly larger than the width of the slot aperture of buckling hook 11 as well as ensuring that buckling ring 41 will not, and without cause, release from the buckling hook 11. On the other hand, the aperture 12 of box body 1 is found to be slightly expanded outward to form a covering part 13. The thickness of the forementioned covering apart 13 is larger than the wall thickness of the box body 1 and, a ring is set at its top plane to surround the groove 14 at the outer rim of aperture 12 for the purpose of laying the sealing member 3. The forementioned sealing member 3 is made of rubber and in the shape of a ring to be housed tightly inside the ring-shaped groove 14. Furthermore, after the assembly has been completed, the top plane of the forementioned sealing member 3 should be so arranged that it will be slightly higher than the top plane of the covering part 13, so as to facilitate an excellent sealing to be made at the space between the box body 1 and the cover 2 and to prevent water from being infiltrated into the box body 1.

The forementioned cover 2 is used to cover the box body 1, and includes two spaced pivot seats 21 (only one is shown in the attached drawings) which are set on one of its lateral sides. The space between the forementioned two pivot seats 21 receives and pivotally joins part 15 so that the lateral side of the box body 1 can be fitted. The pivot seat 21 and the joined part 15 include axial holes 22 and 16 which are in a straight line, and through which the pivot axle 23 can pass, so as to pivotly join the cover 2 onto the box body 1 to facilitate its rotation motion around the axle to open or shut the box body 1. A similar outward expansion is also found at the peripheral rim of the opening 24 of cover 2 to form a covering part 25 and an annular shaped projected rim 26 is also formed along the bottom plane of the covering part 26 and the forementioned projected rim 26 is set a position opposing the groove 14. When the cover 2 is sealed to the box body 1, the projection rim 26 press against the sealing member 3, and be tightly fixed to the box body 1, so as to prevent water from soaking through the covering plane between and box body 1 and the cover 2 into the box. Another important design of the cover 2 is to ensure the tight setting of the buckling member 27 which is integrally formed at another lateral end of cover 2 and comprises a perpendicular part 28, a handle 29 which extends outward out of the extreme end of the forementioned perpendicular part 28 and a sandwiched tongue 30 which is formed in the interior lateral side of the forementioned perpendicular part 28. At the time of the closing of the cover 2, the forementioned tongue 30 engages the bottom plane of the covering part 13 of the box body, so that the cover 2 can be fixed on the box body 1 and thus form a completely sealed container. When the handle 29 is pulled toward an outward direction, the sandwiched tongue 30 will immediately move away from the covering part 13 and cause the cover 2 to open.

The connection of the waistbelt 4 with the box body 1 will be in the same manner as shown in FIGS. 1 & 4. There are buckle rings 41 attached to the two ends of the forementioned waistbelt 4. The exterior rim of the forementioned buckle rings 41 is slightly larger than the width of the opening of the forementioned buckle hook 11, so that pressure will have to be exerted before the buckle ring 41 can be squeezed into the buckle hook 11 to prevent the buckle ring from falling away. Of course, in the course of unbuckling, an appropriate force should be applied toward an outward direction to cause the waistbelt 4 to be released from the buckle hook 11. However, such a design will not cause any difficulty in buckling or unbuckling the waistbelt 4. Apart from this, the length of the waistbelt 4 can be regulated as required to match with the width of the waist of individual users. As for the techniques which is applied to regulating the length of the waistbelt 4, no detailed description is given here because it is of a conventional nature. However, the diving box 10, by means of being tied to the waist of a swimmer of diver, can be used to safely keep the personal belongings someone brings along to the seaside with himself, without causing any disturbance to the sports he is undertaking or causing the user to worry about the safety of these personal belongings.

It should be understand that the forementioned embodiment is only a preferred embodiment of the present invention, and is only an example for explanation purpose. Any changes or alterations of the present invention shall be covered under the spirit and scope of the claims.

What is claimed is:

1. a diving box comprising:

(a) a elongate box body including two longitudinal sides, two ends and an open top, one side including a concave portion for directly engaging the waist or a user;

(b) an elongate cover pivotally connected at a first end thereof to a corresponding first end of the box for opening and closing the top of the box the pivotal connection permitting the cover to be opened and closed across a longitudinal plane of the box that is substantially parallel to the waist of the user when the concave portion is engaged therewith and without interfering with the body of the user;

(c) the cover and box collectively defining substantially oval transverse and longitudinal cross-sectional configurations when the cover is in a closed position;

(d) corresponding sealing means provided on the cover and the box to prevent water from entering the box when the cover is in a closed position;

(e) the second end of the box and the second end of the cover being provided with cooperating locking means for locking the cover to the box in its closed position, which locking means includes an outwardly extending portion provided adjacent the top of the box and defining a downwardly facing surface and a handle carried by the cover and provided with an inwardly extending tongue for releasably engaging the downwardly facing surface; and (f) hook means provided at each end of the box for detachable engagement by the buckles of a waistbelt.

2. The diving box of claim 1 wherein:

(a) the cover and handle are integrally formed of plastic material; and (b) the box, hook means and outwardly extending portion are integrally formed of plastic material.

3. The diving box of claim 1 wherein the sealing means includes:

(a) a groove formed around the perimeter of the box top;

(b) a resilient sealing member disposed within the groove and extending above the top of the box; and (c) a projecting rim formed on the cover in the configuration of the sealing member for engaging same when the cover is disposed in a closed position.

4. The diving box of claim 1 wherein each hook means includes a hollow cylindrical member provided with a longitudinal slot through a side wall thereof for snapfitting a portion of a corresponding buckle thereto.

* * * * *